US006683415B1

(12) United States Patent
Compain et al.

(10) Patent No.: US 6,683,415 B1
(45) Date of Patent: Jan. 27, 2004

(54) FLAT DISPLAY SCREEN WITH A PROTECTION GRID

(75) Inventors: Eric Compain, Asperes (FR); Hervé Sigal, Montpellier (FR)

(73) Assignee: Pixtech, S.A., Rousset (FR)

( * ) Notice: Subject to any disclaimer, the term of this patent is extended or adjusted under 35 U.S.C. 154(b) by 192 days.

(21) Appl. No.: 09/696,470

(22) Filed: Oct. 24, 2000

(30) Foreign Application Priority Data

Oct. 28, 1999 (FR) ..... 99 13753
Mar. 31, 2000 (FR) ..... 00 04171

(51) Int. Cl.[7] ..... H05B 39/00
(52) U.S. Cl. ..... 315/168; 315/169.1; 315/169.3; 313/167; 313/309; 313/336; 345/74.1
(58) Field of Search ..... 315/169.1, 169.3, 315/168; 313/167, 309, 336, 351, 495, 496, 497; 345/74.1, 75.2, 79, 95

(56) References Cited

U.S. PATENT DOCUMENTS 2,431,113 A 11/1947 Glyptis et al. ..... 250/154
4,012,656 A 3/1977 Norman et al. ..... 313/55
5,554,828 A * 9/1996 Primm ..... 178/18.07
5,949,395 A * 9/1999 Stevens et al. ..... 313/496
6,066,915 A * 5/2000 Pepi ..... 313/288
6,081,246 A * 6/2000 Cathey et al. ..... 315/169.3
6,107,733 A * 8/2000 Jager ..... 313/495
6,288,694 B1 * 9/2001 Jager et al. ..... 345/74.1

FOREIGN PATENT DOCUMENTS

EP 0 660 358 A1 6/1995
EP 0 660 368 A1 6/1995
FR 1 329 194 12/1963
FR 2 764 731 12/1998

OTHER PUBLICATIONS

French Patent Office Search Report, Jul. 19, 2000 (2 pages).

* cited by examiner

*Primary Examiner*—Haissa Philogene
(74) *Attorney, Agent, or Firm*—Duane Morris LLP

(57) ABSTRACT

A flat display screen including a.cathode provided with field effect electron emission means, a cathodoluminescent anode placed opposite to the cathode, an extraction grid associated with the cathode, and at least one filtering grid, permeable to electron bombardment and biased to forbid parasitic ions, generated on one side of this filtering grid, to reach the cathode or the anode located on the other side.

13 Claims, 3 Drawing Sheets

FLAT DISPLAY SCREEN WITH A PROTECTION GRID

BACKGROUND OF THE INVENTION

1. Field of the Invention

The present invention relates to flat microtip display screens and, more specifically, to so-called cathodoluminescent screens, the anode of which supports luminescent elements separated from one another by isolating areas and likely to be excited by an electron bombardment. This electron bombardment requires for the luminescent elements to be biased and can originate from microtips or from layers with a low extraction potential.

To simplify the present description, only microtip screens will be considered hereafter, but it should be noted that the present invention generally relates to the various above-mentioned types of screens and the like.

2. Discussion of the Related Art

FIG. 1 shows an example of a conventional structure of a flat color microtip screen of the type to which the present invention relates.

Such a microtip screen is essentially formed of a cathode 1 with microtips 2 and of an extraction grid 3 provided with holes 4 corresponding to the locations of the microtips. Cathode 1 is placed opposite to a cathodoluminescent anode 5, a glass substrate 6 of which forms, for example, the screen surface.

The operating principle and a specific embodiment of a microtip screen are described, for example, in U.S. Pat. No. 4,940,916 of the Commissariat à l'Energie Atomique.

Cathode 1 is organized in columns and is formed, on a substrate 10, for example made of glass, of cathode conductors organized in meshes from a conductive layer. Microtips 2 are made on a resistive layer 11 deposited on the cathode conductors and are arranged within meshes defined by the cathode conductors. FIG. 1 partially shows the inside of a mesh, without showing the cathode conductors. Cathode 1 is associated with grid 3 which is organized in lines. Grid 3 is deposited on the cathode plate with an interposed isolating layer 12. The intersection of a line of grid 3 and of a column of cathode 1 defines a pixel.

This device uses the electric field created between cathode 1 and grid 3 to extract electrons from microtips 2. The electrons are then attracted by phosphor elements 7 of anode 5 if they are properly biased. In the case of a color screen such as illustrated in FIG. 1, anode 5 is, for example, provided with alternate strips of phosphor elements 7r, 7g, 7b, each corresponding to a color (Red, Green, Blue). The strips can be separated from one another by an insulator 8. Phosphor elements 7 are deposited on electrodes 9, for example formed of corresponding strips of a conductive layer (transparent if the anode forms the screen surface) such as indium and tin oxide (ITO). The sets of red, green, blue strips are for example alternately biased with respect to cathode 1, so that the electrons extracted from the microtips 2 of a pixel of the cathode/grid are alternately directed to the phosphor elements 7 facing each of the colors. In the case of a monochrome screen, anode 5 supports phosphor elements of the same color organized in a single plane or in two sets of alternate strips biased, in this case, separately.

Other cathode-grid and anode structures such as those described hereabove can be found. For example, the anode phosphor elements may be distributed in elementary patterns corresponding to the size of the screen pixels. The anode may further, while being formed of several sets of strips or of elementary patterns of phosphor elements, not be switched by sets of strips or patterns. All the strips or patterns then are at a same potential, for example, by being supported by a conductive plane. The anode is then said to be "unswitched" by opposition to "switched" anodes where the colors are alternately biased.

The strips of anode patterns supporting phosphor elements to be excited are biased under a voltage of several hundreds of volts with respect to the cathode. In the case of a screen with a switched anode having several sets of strips, the other strips are at a zero potential. The choice of the values of the biasing potentials is linked to the characteristics of the phosphor elements and of the emitting means on the cathode side.

For an electron emission by the cathode microtips, the cathode must be submitted, with respect to grid 3, to a sufficient potential difference. Conventionally, under a potential difference on the order of 50 V between the cathode and the grid, there is no electron emission, and the maximal emission used corresponds to a potential difference on the order of 80 V. For example, the rows of grid 3 are sequentially biased to a potential on the order of 80 V while the columns of cathode 1 are brought to respective potentials ranging between a maximum emission potential and a no emission potential (for example, respectively 0 and 30 V). The brightness of all the pixels in a line is thus set (per color component, if the anode includes several sets of strips selectively biased color by color). The conventional screen control mode consists of forming several images per second, for example from 50 to 60. A duration of approximately 20 ms is thus available to form each image. This duration is called a frame duration.

A problem which arises in a conventional screen is that ions are present in inter-electrode space 13. Indeed, although the inter-electrode space is designed to be under vacuum, the layers constitutive of the different electrodes as well as the residual gases are likely to generate ions under the effect of the electron bombardment. These positive ions are then attracted by the electrode at the lowest potential.

In normal operation (during display frames or sub-frames), the bombardment of the phosphor elements of the anode by the electrons can result in a production of positive ions. These cations are then accelerated towards the cathode that is at the lowest potential and can damage it physically or chemically.

In some screens, a so-called regeneration addressing mode is provided, which consists of biasing, periodically and outside display periods, the cathode microtips into a state of emission while the anode electrodes are biased to a low potential. An example of a control method of this type is described in European patent application No. 0,747,875 of the applicant.

A problem that is then posed is that the electrons emitted by the cathode fall back on the extraction grid since they are no longer attracted by the anode. This phenomenon goes along with an ionization of the species adsorbed at the grid surface. The cations thus generated are then accelerated towards the anode that is at a zero potential, and contaminate the phosphor elements. This ion bombardment of the anode during regeneration phases causes a different aging of the on and off areas of the screen. Indeed, a drop in the light efficiency of the phosphor elements in the off areas during regeneration phases can be observed.

SUMMARY OF THE INVENTION

The present invention aims at overcoming the disadvantages of conventional screens by providing a novel structure of a screen with a protection against the undesirable effects of parasitic ions. The present invention aims, in particular, at protecting the cathode against positive ions present in the inter-electrode space. The cathode indeed is particularly sensitive to chemical or physical contaminations. Such is the case, in particular, for microtip screens.

The present invention also aims at providing a solution which is particularly simple to implement and which requires no modification either of the anode, or of the cathode, or of the extraction grid of a conventional screen.

The present invention further aims at providing a solution which can be implemented without modifying the conventional manufacturing of a cathode-grid and of a microtip screen anode.

According to a first aspect, the present invention aims at providing a solution that requires no modification of the conventional addressing of the screen electrodes and, in particular, of the respective addressing potentials of the anode, of the cathode, and of the extraction grid.

According to a second aspect, the present invention aims at protecting the phosphor elements of the anode against an ion bombardment while keeping the possibility of performing conventional regeneration periods.

To achieve these objects, the present invention provides a flat display screen including a cathode provided with field effect electron emission means, a cathodoluminescent anode placed opposite to the cathode, an extraction grid associated with the cathode, and at least one filtering grid, permeable to electron bombardment and biased to forbid parasitic ions generated on one side of this filtering grid to reach the cathode or the anode located on the other side.

According to an embodiment of the present invention, said filtering grid can be biased to a potential greater than a maximum biasing potential of the anode.

According to an embodiment of the present invention, said filtering grid can be biased to a negative or null potential.

According to an embodiment of the present invention, the biasing potential of said filtering grid is switchable between said negative or null potential, outside of display periods, and said potential greater than the maximum biasing potential of the anode, during display periods.

According to an embodiment of the present invention, said filtering grid is placed closer to the cathode than to the anode.

According to an embodiment of the present invention, the screen includes a first filtering grid biased to a potential greater than the maximum biasing potential of the anode, and a second filtering grid, closer to the anode than the first filtering grid.

According to an embodiment of the present invention, the second filtering grid is biased to a potential smaller than the maximum biasing potential of the anode and, preferably, smaller than the minimum biasing potential of the cathode.

According to an embodiment of the present invention, the biasing potential of the first filtering grid is switchable between a negative or null potential outside of display periods and a potential greater than the maximum biasing potential of the anode during display periods.

According to an embodiment of the present invention, said or at least one of said filtering grids is integrated to the anode or to the cathode.

The present invention also provides a method for controlling a screen which consists of, during regeneration periods interposed between display periods, biasing the anode to a potential greater than the potentials of the extraction grid and of the cathode, and biasing the additional grid to a negative or null potential.

The foregoing objects, features and advantages of the present invention will be discussed in detail in the following non-limiting description of specific embodiments, in conjunction with the accompanying drawings.

DETAILED DESCRIPTION

Figure 1:
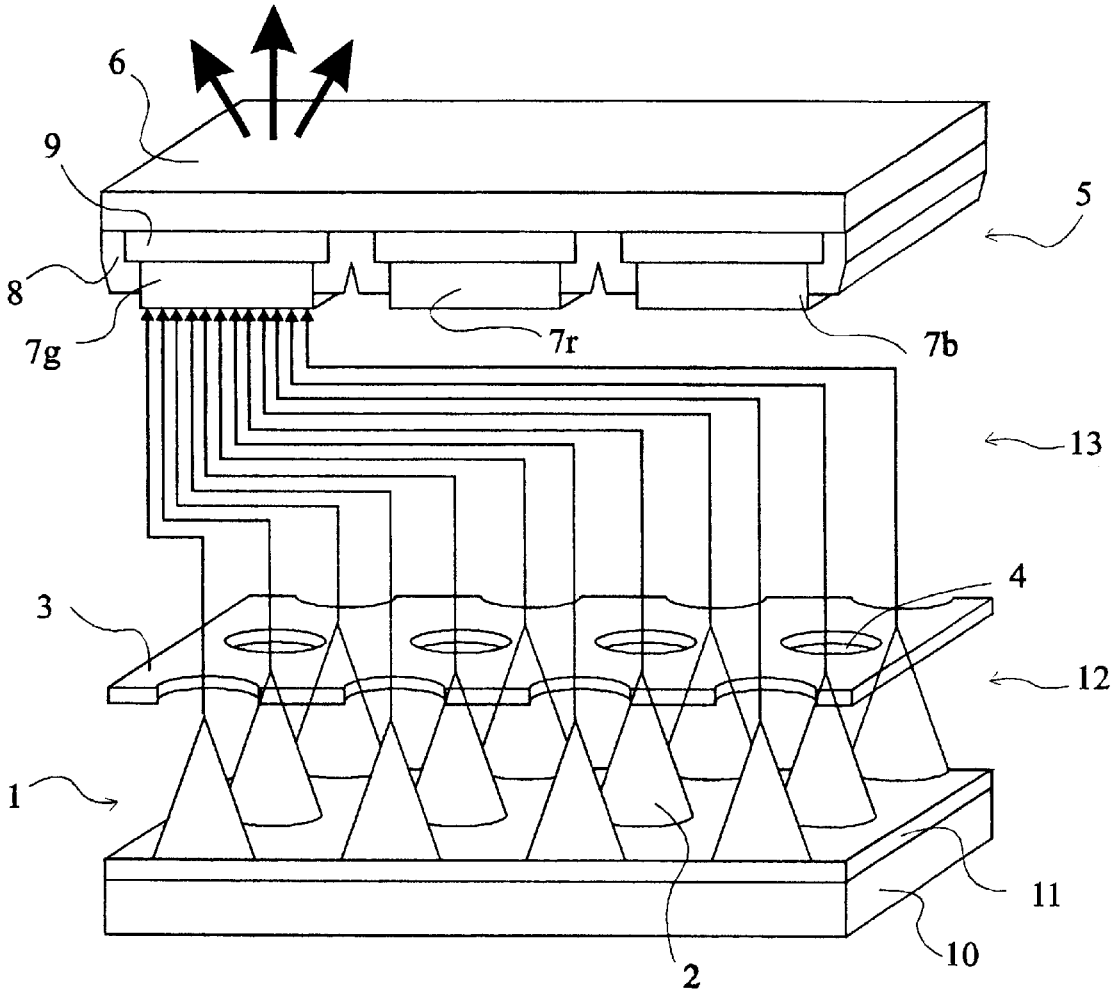
FIG. 1, previously described, is intended to show the state of the art and the problem to solve.

The same elements have been referred to with the same references in the different drawings. For clarity, only those elements which are necessary to the understanding of the present invention have been shown in the drawings and will be described hereafter. In particular, the forming of a cathode-grid or of an anode of a screen according to the present invention will not be detailed and, unless otherwise specified, is no object of the present invention. The present invention applies to any conventional screen structure, whatever the structure of its cathode-grid and of its anode. Further, to simplify, reference will be sometimes made to the cathode to designate the cathode-grid assembly when the component location is desired to be discussed.

A feature of the present invention is to provide, between the extraction grid and the anode of a flat display screen, at least one additional filtering grid, biased to modify the path of parasitic ions and to avoid for parasitic ions appearing on one side of the additional filtering grid to propagate to the other side of this grid to reach the electrode (the anode or the cathode) delimiting the screen on this side.

According to a first aspect of the present invention, the additional filtering grid(s) form a barrier against positive ions which would be likely to reach the cathode, in particular by being emitted by the anode.

According to a second aspect of the present invention, the additional filtering grid(s) trap the ions present in the inter-electrode space at least during regeneration periods between two display periods.

Figure 2:
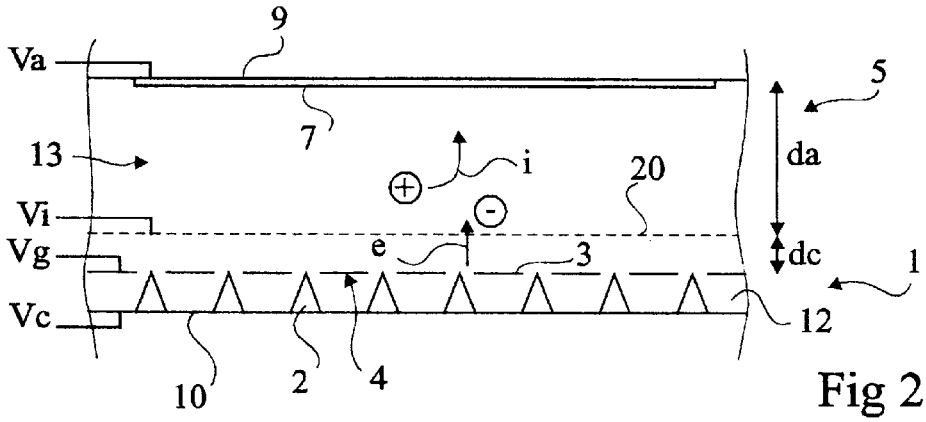
FIG. 2 very schematically and partially shows a first embodiment of a microtip screen according to a first aspect of the present invention.

FIG. 2 partially and very schematically shows a first embodiment of a flat display screen according to the first aspect of the present invention. In FIG. 2, the different elements have been symbolically shown in cross-section.

Conventionally, a flat microtip screen of the present invention includes one or several anode electrodes 9 supporting phosphor elements 7, placed opposite to cathode electrodes 10 supporting electron emission microtips 2. Conventionally still, an extraction grid 3 provided with holes 4 at the locations of the microtips is associated with the cathode (designated by general reference 1) and is deposited on an insulating layer 12. Inter-electrode space 13 is generally under vacuum.

According to the first aspect of the present invention, at least one additional filtering grid 20 is placed between cathode-grid 1 and the anode (designated by general reference 5). According to this first aspect, the function of grid 20 first is to prevent the positive ions generated by anode 5 from bombarding cathode 1. For this purpose, grid 20 is, according to a feature of this embodiment, biased to a potential Vi greater than the highest biasing potential Va of anode 5. Thus, cations i located in the space (interval da) between grid 20 and anode 5 are attracted by the anode which is at the lowest potential. Preferably, biasing potential Vi is greater by at least 20 volts than potential Va, this value of 20 volts being chosen to correspond to the amplitude of the potential barrier necessary to avoid for the ions to cross grid 20, the kinetic energy of the cations upon their creation typically being of a few electron volts.

According to the first embodiment illustrated in FIG. 2, a single additional grid 20 is provided. Preferably, grid 20 is then located closer to cathode 1 than to anode 5 in inter-electrode space 13. Thus, grid 20 has a second effect, which is to prevent the positive ions coming from the ionization of residual gas molecules located in inter-electrode space 13 from reaching the cathode. Grid 20 may be supported by the cathode plate.

Figure 3:
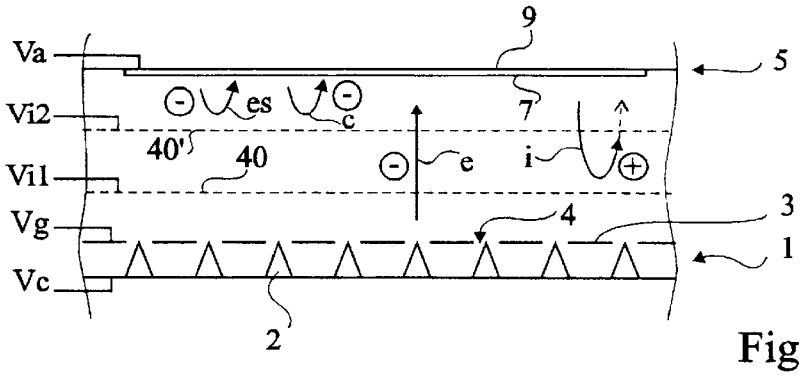
FIG. 3 very schematically and partially shows a second embodiment of a microtip screen according to the first aspect of the present invention.

FIG. 3 shows, in a simplified cross-section view similar to that of FIG. 2, a second preferred embodiment of the present invention according to its first aspect.

According to this embodiment, two additional grids 40 and 40' are provided in inter-electrode space 13. A first grid 40, closer to cathode 1 than second grid 40', has the function, like grid 20 of the first embodiment, of preventing cations i present on the side of anode 5 with respect to grid 40 from reaching cathode 1. Grid 40 is, like grid 20, biased to a potential Vi1 greater than maximum potential Va of the anode.

Second grid 40', placed between anode 5 and first grid 40, has the function of causing a second inversion of the electric field in space 13. This especially enables obstructing the passing of negative ions c and of secondary electrons es emitted by the anode after the electron bombardment. These negatively charged species would otherwise be attracted by first grid 40. Once neutralized on grid 40, these species could be ionized by the electron bombardment of grid 40, then creating cations that are then located between grid 40 and cathode 1, and thus attracted by the latter.

Grid 40' is, according to the present invention, biased to a potential Vi2 smaller than maximum biasing potential Va of anode 5 to repulse the negative species (anions and secondary electrons) thereto. This is compatible with the fact that the electrons emitted by the cathode must remain attracted by the anode. Preferably, potential Vi2 is smaller than minimum biasing potential Vc of the cathode. Thus, the electrons emitted by the cathode do not risk dislodging particles collected by grid 40'.

It should be noted that cations i emitted by the anode are collected by said anode or by grid 40' at the lowest potential while being repulsed by grid 40, and thus do not risk reaching the cathode.

An advantage of the second embodiment where a double inversion of the direction of the electric field between the anode and the cathode-grid is performed, with respect to the first embodiment where a single inversion of the electric field is performed, is that cathode 1 is now protected from both the cations and the anions generated by the anode. As for the first embodiment, grid 40 is preferentially placed as close to the cathode as possible to protect the cathode from the cations generated by the ionization of the residual gas contained in inter-electrode space 13.

Figure 4A:
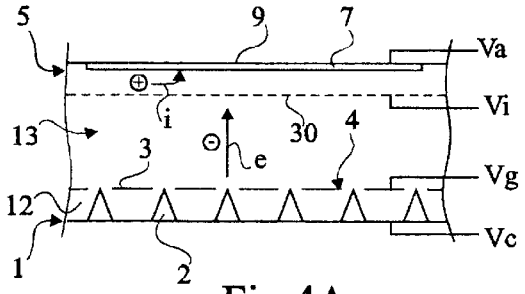
FIGS. 4A and 4B very schematically and partially show an embodiment of a microtip screen according to a second aspect of the present invention in two operating phases.
Figure 4B:
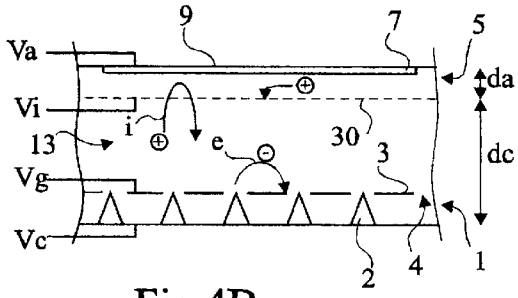

FIGS. 4A and 4B show, in views analogous to the representations of FIGS. 2 and 3, a flat microtip screen according to an embodiment of the second aspect of the present invention.

According to this second aspect, the additional filtering grid has the function of trapping the ions, in particular emitted by the extraction grid under the effect of electrons falling back thereon during regeneration periods.

Conventionally, a microtip screen according to this second aspect is, like the screen of FIGS. 2 and 3, formed of a cathode designated by general reference 1 including cathode electrodes 10 associated with electron emission microtips 2. An extraction grid 3 is deposited on cathode 1 with an interposed insulator 12. Grid 3 is provided with holes 4 at the locations of the microtips to enable passing of electrons towards an electrode 5 formed of one or several electrodes 9 supporting phosphor elements 7.

According to the second aspect of the present invention, an additional grid 30 is placed between cathode 1 and anode 5 in inter-electrode space 13. Although this does not appear from the drawings, grid 30 is preferentially placed close to the cathode, like grid 20 of FIG. 2.

Grid 30 is intended for being addressed by a signal Vi at different potentials according to whether the screen is in a display phase (FIG. 4A) or in a regeneration phase (FIG. 4B). Thus, the second aspect of the present invention more specifically applies to microtip screens that are controlled with a regeneration phase between display periods (frames or sub-frames).

Figure 5:
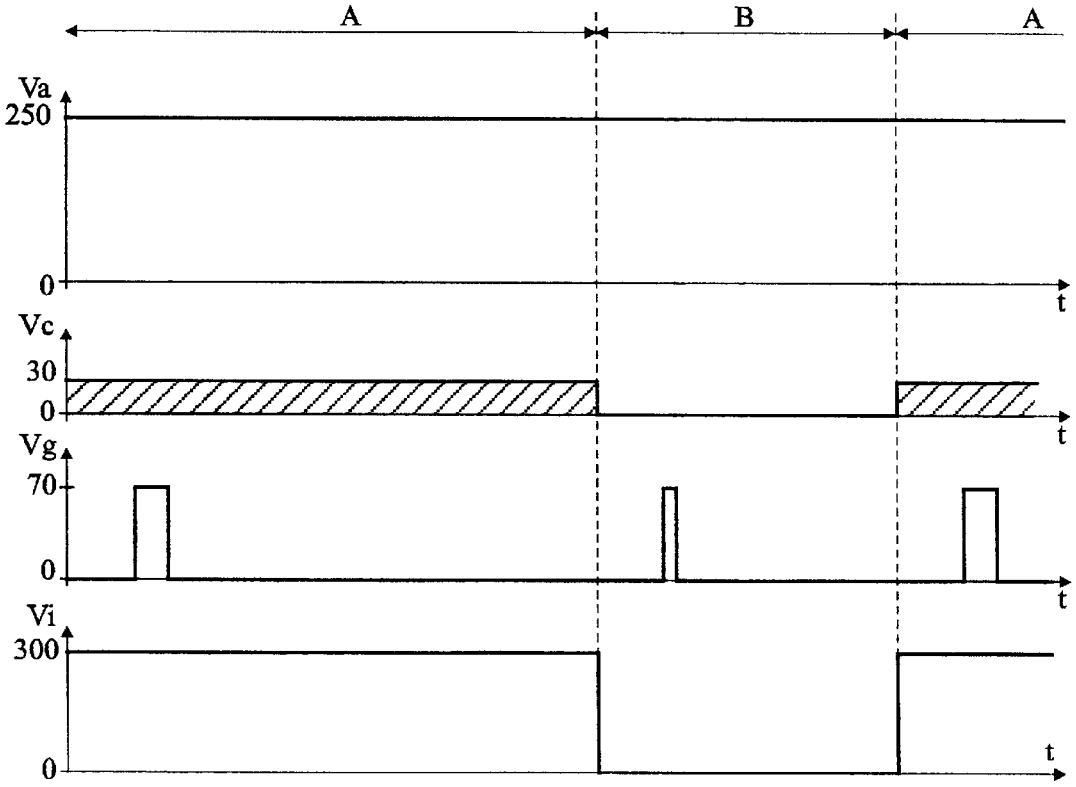
FIG. 5 illustrates, in the form of timing diagrams, an embodiment of a method according to the present invention for controlling the screen of FIGS. 4A and 4B.

FIG. 5 illustrates, in the form of timing diagrams, an example of shape of signals for addressing the different elements of the screen of FIGS. 4A and 4B according to an embodiment of the present invention. This drawing shows respective addressing potentials Va of anode 5, Vc of cathode 1, Vg of a line of extraction grid 3, and Vi of additional grid 30, respectively, during display periods A and during regeneration periods B.

According to this embodiment of the present invention, potential Vi of grid 30 is chosen, during display periods, to be greater than maximum addressing potential Va of anode 5, as in the first aspect of the present invention. Thus, during these periods (FIG. 4A), cations i present between grid 30 and anode 5 are captured by the latter. Electrons e, emitted by the cathode, propagate normally in inter-electrode space 13 to reach anode 5. Further, effects similar to those discussed in relation with the first aspect are obtained since the relations between potentials are the same. In FIG. 5, the fact the potential Vc takes a value between 0 and 30 V according to the luminance set point of the considered pixel has been illustrated by hatchings.

In the example illustrated in FIG. 5, it has been assumed that electrodes 9 of anode 5 are addressed at a 250-V potential and that extraction grid 3 is addressed, per line, at a 70-V potential. Grid 30 is, for example, biased to a potential on the order of 300 V during display periods A.

During frame fly-back periods B, in which are performed regeneration phases of the type described in above-mentioned European patent application No. 0,747,875, additional grid 30 is, according to this embodiment, brought to a zero potential Vi.

In regeneration phases, unlike in the method described in the above-mentioned document, all electrodes 9 of anode 5 are left at their positive potential. Only filtering grid 30 is brought down to a zero, or even lower potential. However, microtips 2 of cathode 1 are placed at maximum emission potentials (for example, 0 V for a grid 3 biased at 80 V). The cations that are then emitted by extraction grid 3 (due to electrons emitted by the microtips that fall back on grid 3) are attracted by filtering grid 30, which is at the zero potential. Since the anode is maintained at a potential greater than that of grid 30, cations i are collected either by grid 30, or by grid 3 after having made an about turn. It should be noted that, during regeneration periods, the biasing of grid 30 is compatible with the desired operation, that is, the electrons are not attracted by anode 5. Indeed, grid 30 acts as a shield against electron bombardment, which is repulsed towards extraction grid 3 at a higher potential.

Of course, in practice, the cathode and grid electrodes are addressed according to their organization in columns and rows, as well as the anode electrodes may be addressed by color in case of a color screen. However, this does not fundamentally change the operation of the present invention. Therefore, in FIG. 5, the cathode column addressing potential Vc during display periods A has been illustrated by any potential ranging between 0 and 30 V while the corresponding lines of grid 3 are sequentially biased to the 70-V potential. Of course, the unaddressed grid lines, as well as, in the case of a switched color anode, the anode electrodes of the unaddressed colors, are at a 0-V potential.

An advantage of the second aspect of the present invention is that it avoids the adverse effects of flat display screen regeneration phases, which are besides useful to avoid a color drift on the anode side or breakdowns due to charge effects on the isolating areas of the cathode.

Figure 6:
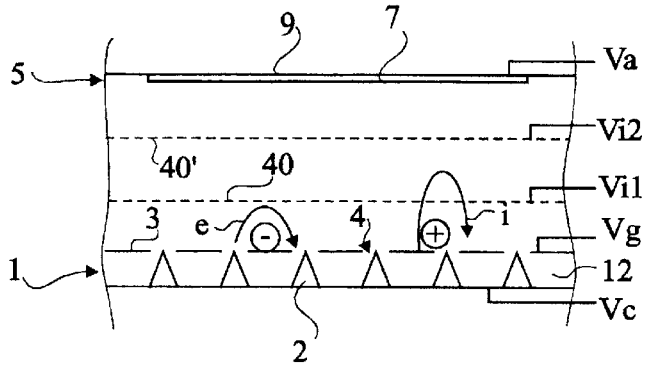
FIG. 6 illustrates, in a view similar to that of FIG. 3, the operation of an alternative embodiment of a screen according to the second aspect of the present invention.

According to an alternative of the second aspect of the present invention, which can be illustrated by FIGS. 3 and 6, a screen may operate with a double grid 40, 40'. During display periods, the screen operates in accordance with the second aspect described in relation with FIG. 3, that is, the additional grids protect the cathode from the ions emitted by the anode and from the residual ionized gas between grid 40 and the anode. Outside of display periods (FIG. 6), that is, during regeneration periods, grid 40 is brought down to a potential Vi1 smaller than potential Vc and grid 40' is brought to a potential Vi2 greater than potential Vg so that the cations do not reach grid 40'. The anode is then protected from the cations emitted on the cathode side.

An advantage of the present invention, whatever the considered aspect, is that it respects the conventional structure of a flat display screen as concerns the anode, the cathode, and the extraction grid.

It should be noted that whatever the considered aspect, the cathode which, in the case of a microtip screen, includes the elements most sensitive to ion bombardment, is protected against such a bombardment.

Another advantage of the present invention is that it is perfectly compatible with the conventional addressing of a flat display screen.

Additional grid(s) 20, 30, 40, or 40' are, preferably, metallic and are designed to have a great transparency to avoid disturbing electron bombardment e from the cathode to the anode. For example, grid 20 has openings that take up 80% of its surface. Actually, the transparency of a grid depends on the distribution of the potential lines in its meshes. For example, for the embodiment of FIG. 3, grid 40' must be very transparent (the field lines inside of the meshes must remain greater than potential Vc) but its conductors advantageously are at a potential lower than potential Vc to avoid being bombarded by electrons.

Additional grid(s) 20, 30, or 40 may be independent plates maintained between cathode 1 and anode 5 by any adapted means, for example, by isolating spacers, preferably regularly distributed in the screen surface, according to the intrinsic mechanical hold of the grid. Any other structure adapted to the desired filtering function may however be provided. For example, a grid may be formed of wires stretched between the screen edges in one or two directions (not necessarily perpendicular), of conductive pellets or grids regularly distributed and bearing on isolating pads supported by the anode or the cathode.

It should be noted that, as an alternative, the additional grid(s) may be resistive or semiconductor grids instead of being metallic.

Of course, the present invention is likely to have various alterations, modifications, and improvements which will readily occur to those skilled in the art. In particular, the choice of the distance separating the additional grid from the anode and from the cathode depends on the chosen embodiment and on possible technical screen manufacturing constraints. For example, in certain cases, it may be preferred not to directly lay a metal grid on the anode to avoid contaminating the phosphor elements. An intermediary spacer structure will then have to be provided to hang a self-supporting grid thereon. However, the additional grid(s) may be provided to be integrated to the cathode-grid and/or to the anode by using manufacturing techniques derived from those of integrated electronic circuits.

Figure 7:
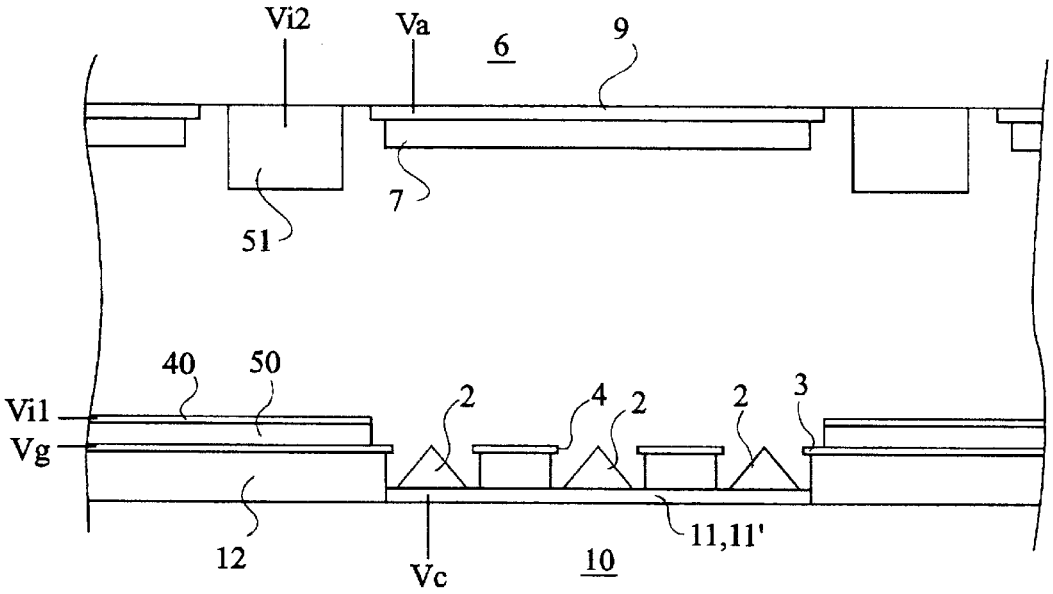
FIG. 7 shows, in a partial cross-section view, an embodiment of a screen according to the first embodiment of the first aspect of the present invention.

An example of implementation of the present invention using such manufacturing techniques is shown in FIG. 7. The various components described in relation with the preceding drawings (substrates 6 and 10, resistive layer 11 shown to be confounded with cathode conductors 11', microtips 2, isolating layer 12, extraction grid 3 provided with holes 4, anode conductors 9, and phosphor elements 7) are shown. Grid 40 is supported by the cathode by being deposited (conductive layer deposition) on grid 3 with an interposed insulating layer 50 and is opened, for example, according to the pixel pattern. Grid 40' is supported by the anode and is formed, for example, by biasable conductive pads 51 (at least at the surface), interposed between elementary anode patterns (9, 7). Potentials Vi1 and Vi2 are set to have equipotentials respecting the conditions discussed hereabove (in particular in relation with FIG. 3).

Further, it should be noted that the present invention can be implemented and of interest, be it for monochrome screens or for color screens, the possibly necessary adaptations of the addressing according to the second aspect of the present invention being within the abilities of those skilled in the art based on the functional indications given hereabove. In particular, the present invention can be implemented whatever the pixel organization and whatever the distribution of the anode electrodes for the phosphor elements.

Further, although the present invention has been described hereabove in relation with a microtip screen, it should be noted that it more generally applies to all types of field effect screens in which a cathodoluminescent anode undergoes an electron bombardment.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A flat display screen including:

a cathode provided with field effect electron emission means;

a cathodoluminescent anode disposed opposite to the cathode; and an extraction grid associated with the cathode, and including at least one filtering grid permeable to electron bombardment and biased, to forbid parasitic ions, generated on one side of said filtering grid, to reach the cathode or the anode located on the other side.

2. The screen of claim 1, wherein said filtering grid can be biased to a potential (Vi) greater than a maximum biasing potential (Va) of the anode.

3. The screen of claim 1, wherein said filtering grid can be biased to a negative or null potential (Vi).

4. The screen of claim 2, wherein the biasing potential (Vi) of said filtering grid is switchable between said negative or null potential, outside of display periods, and said potential greater than the maximum biasing potential (Va) of the anode, during display periods.

5. The screen of claim 1, wherein said filtering grid is placed closer to the cathode than to the anode.

6. The screen of claim 1, wherein said at least one filtering grid comprises a first filtering grid biased to a potential greater than the maximum biasing potential (Va) of the anode, and a second filtering grid disposed closer to the anode than the first filtering grid.

7. The screen of claim 6, wherein the second filtering grid is biased to a potential smaller than the maximum biasing potential of the anode and, smaller than the minimum biasing potential (Vc) of the cathode.

8. The screen of claim 6, wherein the biasing potential of the first filtering grid is switchable between a negative or null potential outside of display periods and a potential greater than the maximum biasing potential (Va) of the anode during display periods.

9. The screen of claim 1, wherein said at least one filtering grid is integrated to the anode or to the cathode.

10. The screen of claim 2, wherein said filtering grid is placed closer to the cathode than to the anode.

11. The screen of claim 2, wherein said filtering grid can be biased to a negative or null potential (Vi).

12. The screen of claim 3, wherein the biasing potential (Vi) of said filtering grid is switchable between said negative or null potential, outside of display periods, and said potential greater than the maximum biasing potential (Va) of the anode, during display periods.

13. A method for controlling a flat display screen having a cathode with field effect electron emission means, an anode opposite the cathode, an extraction grid associated with the cathode and at least one filtering grid, said method comprising:

during regeneration periods interposed between display periods, biasing the anode to a potential greater than the potentials of the extraction grid and of the cathode, and biasing the at least one filtering grid to a negative or null potential.

* * * * *